US006793895B1

(12) United States Patent
Wieres et al.

(10) Patent No.: US 6,793,895 B1
(45) Date of Patent: Sep. 21, 2004

(54) METHOD AND DEVICE FOR PRODUCING A METALLIC HONEYCOMB BODY

(75) Inventors: Ludwig Wieres, Overath (DE); Hans-Peter Caspar, Troisdorf (DE); Christof Müller, Overath (DE)

(73) Assignee: EMITEC Gesellschaft fuer Emissionstechnologie mbH, Lohmar (DE)

( * ) Notice: Subject to any disclaimer, the term of this patent is extended or adjusted under 35 U.S.C. 154(b) by 722 days.

(21) Appl. No.: 09/694,570

(22) Filed: Oct. 23, 2000

Related U.S. Application Data

(63) Continuation of application No. PCT/EP99/02585, filed on Apr. 16, 1999.

(30) Foreign Application Priority Data

Apr. 21, 1998 (DE) ..... 198 17 787

(51) Int. Cl.[7] ..... B01D 53/34; B21D 51/16

(52) U.S. Cl. ..... 422/177; 422/180; 502/439; 228/181; 228/183; 228/193; 29/890

(58) Field of Search ..... 29/890; 422/180, 422/177; 502/439; 228/181, 183, 193

(56) References Cited

U.S. PATENT DOCUMENTS 4,677,839 A * 7/1987 Retallick ..... 72/402
5,094,074 A * 3/1992 Nishizawa et al. ..... 60/300
5,724,735 A * 3/1998 Ickes et al. ..... 29/890
5,755,025 A * 5/1998 Wirth et al. ..... 29/840
5,960,529 A * 10/1999 Haesemann et al. ..... 29/516
6,049,980 A * 4/2000 Wieres ..... 29/890
6,389,693 B1 * 5/2002 Aranda et al. ..... 29/890

FOREIGN PATENT DOCUMENTS

EP 0 820 830 A2 1/1998

OTHER PUBLICATIONS

Published European Patent Application No. 0 703 354 A2 (Wirth et al.), dated Mar. 27, 1996, pertains to a method for the production of a catalytic converter...

Published International Application No. WO 97/06358 (Wieres), dated Feb. 20, 1997, as mentioned on pp. 2 and 3 of the specification.

* cited by examiner

*Primary Examiner*—Glenn Caldarola
*Assistant Examiner*—Alexis Wachtel
(74) *Attorney, Agent, or Firm*—Laurence A. Greenberg; Werner H. Stemer; Ralph E. Locher

(57) ABSTRACT

A method for producing a metallic honeycomb body, according to which at least partly structured metal sheet is coiled, laminated or looped to form a matrix. The matrix is oscillated by an external excitation and during or after the external excitation is introduced into a casing tube.

14 Claims, 2 Drawing Sheets

METHOD AND DEVICE FOR PRODUCING A METALLIC HONEYCOMB BODY

CROSS-REFERENCE TO RELATED APPLICATION

This is a continuation of copending International Application PCT/EP99/02585, filed Apr. 16, 1999, which designated the United States.

BACKGROUND OF THE INVENTION

Field of the Invention

The subject of the invention relates to a method for producing a metallic honeycomb body and to a device for producing a metallic honeycomb body.

For the reduction of pollutants in exhaust gases, in particular in motor vehicle exhaust gases, so-called catalysts are used. The catalysts contain a carrier body which is provided with a catalytically active coating. The carrier body has a multiplicity of ducts through which an exhaust gas is capable of flowing. It has a honeycombed structure, and therefore such carrier bodies are designated as honeycomb bodies.

It is known that such a honeycomb body may be a monolithic body that is produced, for example, from a ceramic material.

Honeycomb bodies are also known which contain a metallic material. Such honeycomb bodies may be produced, for example, by sintering or casting. Metallic honeycomb bodies that contain at least partially structured sheet metal layers are also known.

European Patent EP 0 263 324 B1 describes a metallic honeycomb body which is formed from a corrugated or a smooth and a corrugated metal strip. The metal strip or metal strips are wound or folded to form a plurality of layers contiguous to one another. European Patent EP 0 263 324 B1 shows a spirally wound honeycomb body. The spirally wound honeycomb body is introduced into a casing tube with the aid of an introduction unit.

International Patent Disclosure WO 97/06358 discloses a method for producing a honeycomb body having a multiplicity of ducts permeable to a fluid, from a multiplicity of at least partially structured metal sheets. According to this method, a stack composed of a plurality of at least partially structured metal sheets is disposed in layers. The stack is introduced into an open mold and is held in the latter in a central region by a holding device. At least two mold segments of the mold are in each case displaced out of their initial positions in such a way that at least a portion of each casing section comes to bear on the stack and is subsequently moved along a path of movement corresponding to the outer shape until a predetermined degree of wrap is achieved. The mold is then closed. The matrix thus produced is introduced into a casing tube.

International Patent Disclosure WO 97/06358 describes, furthermore, a method in which a plurality of stacks composed of a plurality of at least partially structured metal sheets are disposed in layers. Each stack is folded in each case about a bending line. The stacks are introduced into an open mold and are held in the latter in a central region by a holding device. At least two mold segments are in each case displaced out of their initial positions in such a way that at least a portion of each casing section comes to bear on the stack and is subsequently moved along a path of movement corresponding to the outer shape until a predetermined degree of wrap is achieved. The mold is then closed. The matrix thus produced is introduced into a casing tube.

International Patent Disclosure WO 97/00135 discloses further methods for producing a honeycomb body, having a multiplicity of ducts permeable to a fluid, from a multiplicity of at least partially structured sheet metal layers. In these methods too, a matrix composed of at least one at least partially structured sheet metal layer, which is wound, layered or wrapped, is formed. The matrix is introduced into a casing tube.

While the matrix is being produced, stresses distributed unevenly over the cross section of the matrix occur and may lead to defects and to dimensional inaccuracies after a soldering operation that follows the production of the honeycomb body. This problem arises to an increased extent when the matrix is formed from sheet metal layers that have a microstructure and a macrostructure, in particular a transverse microstructure.

SUMMARY OF THE INVENTION

It is accordingly an object of the invention to provide a method and a device for producing a metallic honeycomb body that overcomes the above-mentioned disadvantages of the prior art methods and devices of this general type, in which an equalization of the stresses over the cross section of a matrix is obtained.

With the foregoing and other objects in view there is provided, in accordance with the invention, a method for producing a metallic honeycomb body. The method includes the steps of providing a matrix formed of at least one at least partially structured sheet metal layer being one of wound, layered and wrapped to form the matrix; vibrating the matrix by an external excitation; and introducing the matrix into a casing tube.

In the method according to the invention, the matrix is wound, layered or wrapped from at least one at least partially structured sheet metal layer. The matrix is set in vibration by the external or independent excitation and is introduced into the casing tube during the excitation or after the excitation. Since the matrix is set in vibration by the excitation, an equalization of the stresses in the cross section of the matrix is achieved. This equalization also leads to possible gaps between adjacent sheet metal layers being closed, since, due to the independent excitation of the matrix, an essentially homogeneous relief of stress of the matrix occurs. A more even stress distribution also leads, in the case of a matrix containing smooth and structured sheet metal layers, to the contact forces at the contact points between the smooth and the structured sheet metal layers being distributed more homogeneously, with the result that an improved diffusion connection can be achieved between the sheet metal layers or between the matrix and the casing tube.

It became clear, in particular, that, in the method according to the invention, a more homogeneous stress distribution over the cross section of the matrix can be achieved in the matrix that is formed by sheet metal layers with a microstructure and a macrostructure.

The excitation of the matrix may take place periodically, in a pulse-like manner or randomly in time. It is particularly expedient if the matrix is set in vibration by periodic excitation.

According to a further advantageous refinement of the method, it is proposed that the matrix be set in vibration by kinematic excitation. The advantage of this is that the excitation can be carried out at relatively low outlay. In particular, a kinematic excitation of the matrix has the advantage that relatively low sound emission due to the kinematic excitation occurs.

Alternatively or additionally to a kinematic excitation of the matrix, it is proposed that the matrix be set in vibration by the action of force. The advantage of external excitation by the action of force is that the excitation can be achieved by a relatively high frequency. Furthermore, a predetermined energy can be introduced into the matrix by the action Of force.

According to a further advantageous refinement of the method, it is proposed that the matrix be introduced into the casing tube by the introduction or guide unit, the matrix being compressed and set in vibration during the leadthrough operation. The advantage of this procedure is that the forces necessary for introducing the matrix into the casing tube are reduced. This also results in a reduction in the deformation of the matrix in an end face on which engages a transport element pushing the matrix into the casing tube. This also leads to an improvement in the quality of the honeycomb body.

The excitation of the matrix preferably takes place in such a way that the matrix is set in transverse vibration by the excitation.

According to a further idea of the invention, a device is proposed for producing a metallic honeycomb body which has at least one matrix which is wound, layered or wrapped from at least one at least partially structured sheet metal layer and which is disposed in the casing tube. The device is distinguished by a introduction unit which has an entry orifice and an exit orifice and also a guide duct narrowing from the entry orifice toward the exit orifice. A transport element is capable of being moved in the duct and out of it, the transport element pushing a matrix through the entry orifice into the duct and pressing it via the exit orifice out of the guide unit into a casing tube. The device according to the invention has an exciting unit that is connected to the guide unit and by which the guide unit is set in vibration. The guide unit is set in vibration, in particular, transversely to the axial direction of the duct. When a matrix is located in the guide unit, the matrix is set in vibration via the guide unit, with the result that an essentially homogeneous relief of stress of the matrix is achieved in the guide unit.

To simplify the introduction of the matrix into a casing tube and for positioning the casing tube exactly in relation to the duct, it is proposed that the exit orifice be followed by a positioning unit, by which the casing tube can be positioned essentially coaxially to the duct.

According to a further advantageous refinement of the device, it is proposed that the entry orifice be preceded by a centering unit, so that it becomes simpler for the matrix to be introduced into the duct of the guide unit.

According to a further advantageous refinement of the device, it is proposed that the introduction or guide unit be mounted elastically. An active insulation of the guide unit is achieved by the elastic mounting of the guide unit. By virtue of the active insulation of the vibration unit, no or only very slight vibrational forces pass into the surroundings. External concussions do not reach the guide unit, or only to a very slight extent, so that passive insulation is also afforded.

According to a further advantageous refinement of the device, it is proposed that the exciting unit introduce an oscillating force into the guide unit, the force running essentially transversely to the longitudinal direction of the duct. Alternatively or additionally, the exciting unit may set the guide unit kinematically in vibration transversely to the longitudinal direction of the duct.

Other features which are considered as characteristic for the invention are set forth in the appended claims.

Although the invention is illustrated and described herein as embodied in a method and a device for producing a metallic honeycomb body, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
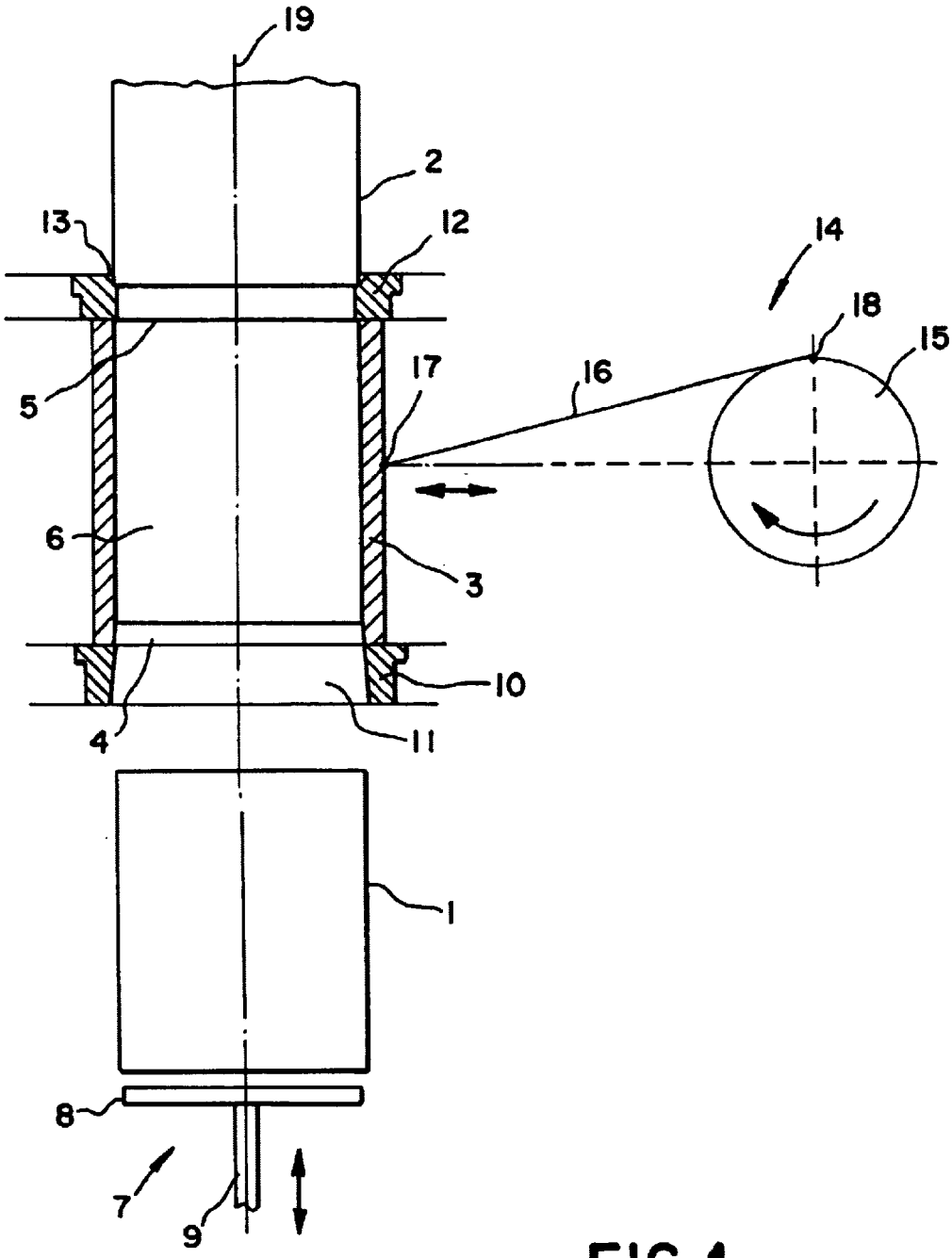
FIG. 1 is a diagrammatic, sectional view of a first exemplary embodiment of a device for producing a metallic honeycomb body according to the invention.

In all the figures of the drawing, sub-features and integral parts that correspond to one another bear the same reference symbol in each case. Referring now to the figures of the drawing in detail and first, particularly, to FIG. 1 thereof, there is shown a matrix 1 which is wound, layered or wrapped from at least one at least partially structured sheet metal layer. The matrix 1 may be produced by one of the methods described in International Patent Disclosure WO 97/00135, International Patent Disclosure WO 97/06358 or European Patent EP 0 263 324 B1. Other methods are also possible. The matrix 1 has ducts, through which an exhaust gas is capable of flowing and which are delimited by the wound, layered or wrapped sheet metal layers.

The device has an introduction unit 3. The introduction unit has an entry orifice 4 and an exit orifice 5. The entry orifice 4 and the exit orifice 5 are connected to one another by a guide duct 6. The guide duct 6 narrows in cross section from the entry orifice 4 toward the exit orifice 5.

The introduction unit 3 is preceded by a centering unit 10 having a centering duct 11 that narrows toward the entry orifice 4.

The introduction unit 3 is followed by a positioning unit 12. The positioning unit 12 has a positioning slope 13. The positioning unit 12 is of an annular configuration. A free end region of a casing tube 2 engages into the introduction slope 13. The casing tube 2 is oriented essentially coaxially to an axis 19 of the guide duct 6 by the positioning slope 13.

The introduction unit 3 is mounted elastically. The elastic mounting of the introduction unit 3 is not illustrated in the exemplary embodiment shown. The elastic mounting may, for example, contain elastomeric elements or air cushions, on which the introduction unit 3 is mounted.

An exciting unit 14 is connected to the introduction unit 3. The exciting unit 14 contains a disk 15 that is connected to a non-illustrated drive unit. The disk 15 is connected to the introduction unit 3 via a rod 16. The connection of the rod 16 to the introduction unit 3 is articulated at 17. The connection of the rod 16 to the disc 15 is also articulated at 18. The disk 15 is capable of being set in rotational movement according to the arrow illustrated in FIG. 1. The rotational movement of the disk 15 is converted into a translational movement of the introduction unit 3 by the rod 16 and the articulated connections 17, 18, so that the introduction unit 3 is set in vibration about the axis 19.

The amplitude of the vibration transversely to the axis 19 is not so great that the matrix 1 is subjected to shearing stress when it is led through the centering unit 10 into the introduction unit 3 or out of the introduction unit 3 into the positioning unit 12. The matrix 1 is pushed into the introduction unit 3 along the axis 19 via the centering unit 10. The matrix 1 is pushed out of the introduction unit 3 into the casing tube 2 via the positioning unit 12. A transport element 7 is provided for moving the matrix 1. The transport element 7 has a ramhead 8 that is connected to an actuating rod 9. The ramhead 8 presses against an end face of the matrix 1, so that the matrix 1 can be moved toward the casing tube 2. After the matrix 1 has been introduced into the casing tube 2, the transport element 7 is moved back into its initial position, so that the latter is ready for introducing a further matrix 1 into a further casing tube 2, which have been positioned in the meantime.

The matrix 1 is set in vibration by the exciting unit 14 during the transport of the matrix 1 in the introductory unit 3 toward the casing tube 2, with the result that the matrix 1 undergoes an equalization of stresses within the matrix 1, as viewed over the cross section.

Since the vibrations take place transversely to the direction of movement of the matrix 1 and therefore also to the transport element 7, the force required for introducing the matrix 1 into the casing tube 2 is lowered.

Figure 2:
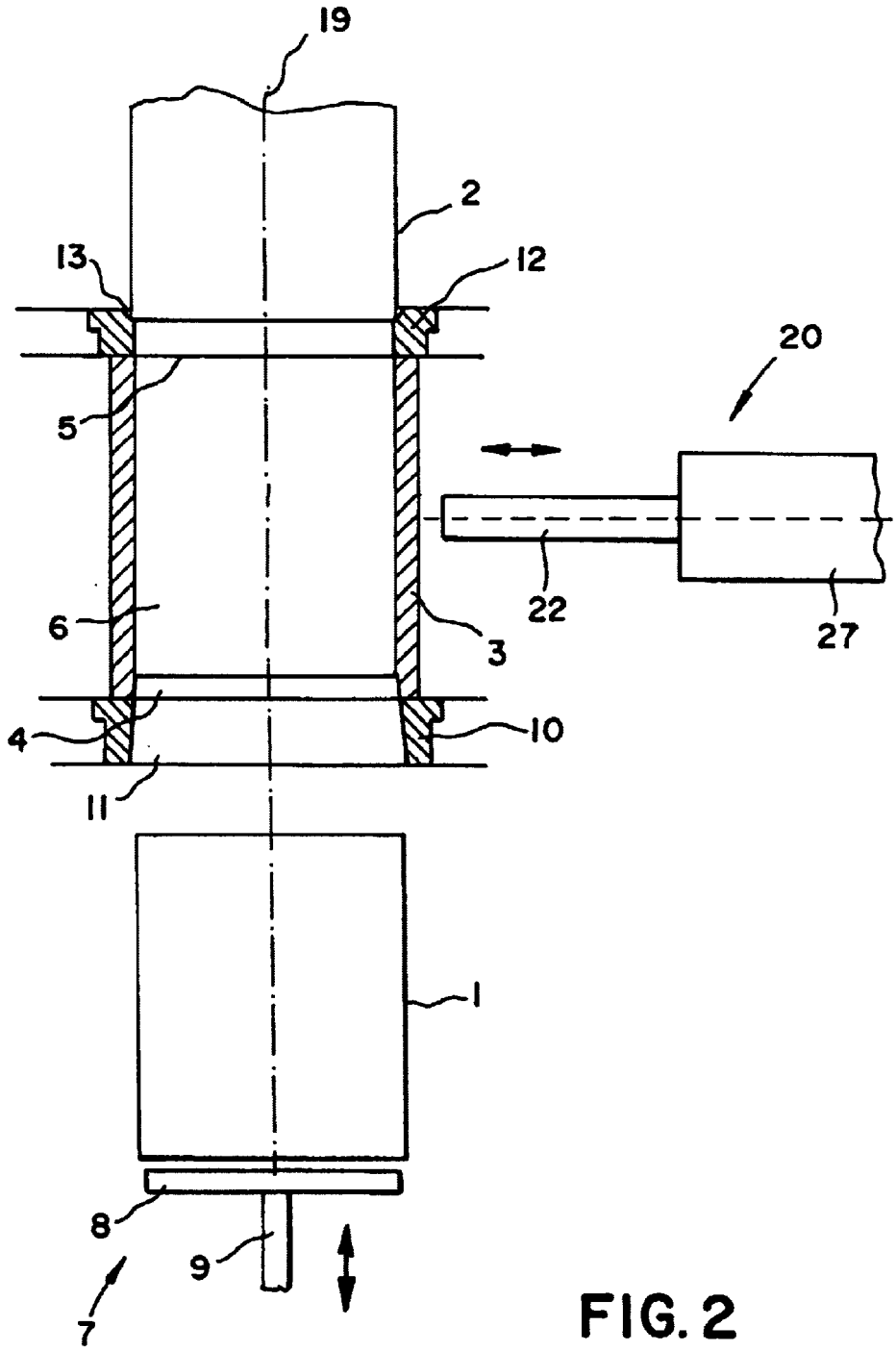
FIG. 2 is a diagrammatic, sectional view of a second exemplary embodiment of the device for producing the metallic honeycomb body.

FIG. 2 shows a second exemplary embodiment of the device for producing the metallic honeycomb body. The device contains the introduction unit 3 that has the entry orifice 4 and the exit orifice 5. The entry orifice 4 is connected to the exit orifice 5 via the guide duct 6. The guide duct 6 narrows toward the exit orifice 5. The guide duct 6 is essentially of a conical shape in cross section.

The introduction unit 3 is preceded by the centering unit 10 which has the centering duct 11. The centering duct 11 likewise has a conical shape.

The introduction unit 3 is followed by the essentially annularly configured positioning unit 12. The positioning unit 12 has, on one end face, the positioning slope 13, into which the end region of the casing tube 2 can be introduced. The casing tube 2 can be oriented coaxially to the axis 19 of the guide duct 6 by the positioning slope 13.

The introduction unit 3 is mounted elastically, so that it is uncoupled vibrationally from the surroundings. The introduction unit 3 can be set in vibration by an exciting unit 20. The exciting unit 20 contains a drive unit 21 and a tappet 22. The tappet 22 is capable of being moved back and forth essentially transversely to the axis 19. A free end of the tappet 22 conducts a force in a pulse-like manner into the introduction unit 3, with the result that the latter and also the matrix 1 located in the introduction unit 3 are set in vibration.

The matrix 1 is introduced into the introduction unit 3 and transported from the latter into the casing tube 2 by the transport element 7. The transport element 7 contains the ramhead 8 that is connected to the actuating rod 9.

We claim:

1. A method for producing a metallic honeycomb body, which comprises the steps of:

providing a matrix formed of at least one at least partially structured sheet metal layer being one of wound, layered and wrapped to form the matrix;

vibrating the matrix by an external excitation; and introducing the matrix into a casing tube.

2. The method according to claim 1, which comprises vibrating the matrix by an external periodic excitation.

3. The method according to claim 1, which comprises vibrating the matrix by an external kinematic excitation.

4. The method according to claim 1, which comprises vibrating the matrix by an action of force.

5. The method according to claim 1, which comprises using an introduction unit for introducing the matrix into the casing tube, the matrix being compressed and set in vibration during a lead-through operation.

6. The method according to claim 1, which comprises setting the matrix in transverse vibration by the external excitation.

7. The method according to claim 1, which comprises introducing the matrix into the casing tube during a performance of the external excitation.

8. The method according to claim 1, which comprises introducing the matrix into the casing tube after the external excitation is completed.

9. A device for producing a metallic honeycomb body having at least one matrix being one of wound, layered and wrapped from at least one at least partially structured sheet metal layer and disposed in a casing tube, comprising:

an introduction unit having an entry orifice formed therein, an exit orifice formed therein, and a guide duct formed therein and narrowing from said entry orifice toward said exit orifice;

a transport element capable of moving into and out of said guide duct; and an exciting unit connected to said introduction unit for vibrating said introduction unit.

10. The device according to claim 9, including a positioning unit following said exit orifice and by which the casing tube can be positioned substantially coaxially to said guide duct.

11. The device according to claim 9, including a centering unit preceding said entry orifice.

12. The device according to claim 10, wherein said introduction unit is mounted elastically.

13. The device according to claim 9, wherein said exciting unit introduces an oscillating force into said introduction unit, the oscillating force running substantially transversely to a longitudinal direction of said guide duct.

14. The device according to claim 9, wherein said exciting unit sets the introduction unit kinematically in vibration transversely to a longitudinal direction of said guide duct.

* * * * *